US010210851B2

(12) United States Patent
Mihos et al.

(10) Patent No.: US 10,210,851 B2
(45) Date of Patent: Feb. 19, 2019

(54) DRUM HOOP FOR HOLDING A DRUMHEAD

(71) Applicant: Angel Drums LLC, Norton, MA (US)

(72) Inventors: Theodore Mihos, Norton, MA (US); Robert Horvath, Nagykallo (HU)

( * ) Notice: Subject to any disclaimer, the term of this patent is extended or adjusted under 35 U.S.C. 154(b) by 0 days.

(21) Appl. No.: 14/601,907

(22) Filed: Jan. 21, 2015

(65) Prior Publication Data

US 2015/0206517 A1 Jul. 23, 2015

Related U.S. Application Data

(60) Provisional application No. 61/929,929, filed on Jan. 21, 2014.

(51) Int. Cl.
*G10D 13/02* (2006.01)

(52) U.S. Cl.
CPC ..... *G10D 13/023* (2013.01)

(58) Field of Classification Search
USPC ..... 84/411 R
See application file for complete search history.

(56) References Cited

U.S. PATENT DOCUMENTS 4,246,825 A 1/1981 Hodas
4,475,434 A * 10/1984 Willis ..... G10D 13/02 84/411 R
4,833,964 A * 5/1989 Prouty ..... G10D 13/028 84/411 R
4,870,883 A * 10/1989 Gauger ..... G10D 13/023 84/413
5,410,938 A * 5/1995 Kurosaki ..... G10D 13/023 84/411 R
5,645,253 A * 7/1997 Hoshino ..... F16M 11/14 248/181.1
6,093,877 A * 7/2000 Nickel ..... G10D 13/025 84/411 R
6,417,432 B1 * 7/2002 Downing ..... G10D 13/023 84/411 A
6,891,098 B1 5/2005 Lombardi
6,953,883 B1 10/2005 Jacobson
7,442,867 B1 * 10/2008 Hunter ..... G10D 13/02 84/411 R
7,491,877 B1 * 2/2009 Cherny ..... G10D 13/02 84/411 R
7,888,574 B1 2/2011 Acoutin
2004/0168563 A1 9/2004 Dorfman et al.
2010/0313733 A1 12/2010 Holl et al.
2014/0360338 A1 * 12/2014 Worrall ..... G10D 13/023 84/411 R

* cited by examiner

*Primary Examiner* — Christopher Uhlir
(74) *Attorney, Agent, or Firm* — Giordano Law LLC

(57) ABSTRACT

This disclosure is directed to a drum hoop comprising a rim and tension bolt attachment moieties. The tension bold attachment moieties are attached to the rim and configured so that when the drum hoop receives a drumhead, the drumhead fits in the drum hoop snugly and there is little, or no, excess space between the drum hoop and drumhead.

20 Claims, 3 Drawing Sheets

DRUM HOOP FOR HOLDING A DRUMHEAD

PRIORITY

This application claims priority to U.S. Provisional Application No. 61/929,929, filed Jan. 21, 2014. The entire disclosure of that application is incorporated herein by reference.

FIELD

This disclosure relates generally to musical instruments. In particular, this disclosure relates to percussion instruments.

BACKGROUND

A drum can have a drumhead on one or both ends of the drum. The drumhead includes a membrane, typically stretched over a round rim. The drumhead is struck by sticks or hands or some other object that causes the drumhead to vibrate and causes sound to resonate through the drum.

The drumhead fits into a drum hoop (also called a "rim") that holds the drumhead against a drum shell. Typically, the drum hoop holds the drumhead against the drum shell by bolts (called "tension rods" or "tension bolts") that go through openings on a flanged rim on the drum hoop and are threaded into lugs attached to the drum shell. In some drums, the drum hoop has a single flange rim with claws or hooks through which the bolts go. When the bolts are tightened, the claws tighten to grab, pull, and hold the drumhead against the drum shell.

The most common type of drum hoop is flanged. Typically, a flanged drum hoop is comprised of metal of varying thickness folded in a series of 90-degree bends. Usually, flanged drum hoops have three bends and are referred to as "triple-flanged" hoops. The metal is usually stamped to bend it. Holes to receive the tension rods are typically punched into the metal.

As with other instruments, a drum must be tuned before use. Typically, a drum hoop has a slightly larger diameter than the drumhead so there is excess space between the drumhead and the drum hoop. A drumhead must be centered in the drum hoop in order for the drum to emit its proper sound. If the drumhead is not centered in the hoop, then the drumhead will not be centered over the drum shell. When this happens, the drumhead can be muffled, and the drum will be improperly tuned and produce poor sound quality.

When tuning a drum, the drumhead must be centered in the drum hoop before tightening the tension bolts. Currently, drums are tuned by visually placing the drumhead in the center of the hoop and gradually tightening the tension bolts one at a time while repeatedly tapping the drumhead to check for proper sound quality and repeatedly visually inspecting the drumhead to ensure that it is centered in the drum hoop. Such repetition causes the drum-tuning process to be tedious and prone to error.

SUMMARY

This disclosure is directed to a drum hoop that overcomes the problems described above. One aspect of this disclosure is directed to a drum hoop comprising an annular rim comprising a face and an outside surface and a plurality of tension bolt attachment moieties. Each tension bolt attachment moiety comprises an inside surface and an opening for receiving a tension bolt. Each tension bolt attachment moiety is configured on the annular rim so that the inside surface of each tension bolt attachment moiety contacts the outside surface of the annular rim and so that a portion of each tension bolt attachment moiety extends beyond the face of the rim. Such a configuration allows the drumhead to sit against the face or edge of the annular rim with the tension bolt attachment moieties in close proximity around it. This configuration eliminates or significantly reduces excess space between a drumhead and the drum hoop, thereby allowing a drumhead to fit snugly into the drum hoop. When used on a drum shell, this configuration allows the drumhead to be easily centered over the drum shell.

In some embodiments, the tension bolt attachment moieties are permanently attached to the drum hoop. In some embodiments, the tension bolt attachment moieties are not permanently attached to the rim. In embodiments where the tension bolt attachment moieties are not permanently attached to the rim, the tension bolt attachment moieties can comprise claws or hooks. In some embodiments, the tension bolt attachment moieties are configured on the rim so that the drumhead snaps into the drum hoop.

The tension bolt attachment moieties can be different shapes. In some embodiments, the tension bolt attachment moieties are shaped like half-moons. In other embodiments, the tension bolt attachment moieties are rectangular. In still other embodiments, the tension bolt attachment moieties are triangular. In further embodiments, the tension bolt attachment moieties are square. In some embodiments, the tension bolt attachment moieties are tubular. In other embodiments, the tension bolt attachment moieties are odd-shaped. In some embodiments, the tension bolt attachment moieties attached to the drum hoop do not all have the same shape.

Another aspect of this disclosure is directed to a drum hoop comprising a first annular rim comprising an outside surface, an outside diameter, and a face and an annular tension bolt attachment rim comprising an inside surface, an inside diameter equal to the outside diameter of the first annular rim, and a plurality of tension bolt attachment moieties, wherein each tension bolt attachment moiety comprises an opening for receiving a tension bolt. The annular tension bolt attachment rim is attached to the first annular rim so that the inside surface of the annular tension bolt attachment rim contacts the outside surface of the first annular rim and so that a portion of the annular tension bolt attachment rim extends beyond the face of the first annular rim. Such a configuration allows the drumhead to sit against the face or edge of the first annular rim with the tension bolt attachment rim around it. This configuration eliminates or significantly reduces excess space between a drumhead and the drum hoop, thereby allowing a drumhead to fit snugly into the drum hoop. On an assembled drum, the drum hoops of this disclosure allow the drumhead to be easily centered on the drum shell.

In some embodiments, the annular tension bolt attachment rim is permanently attached to the annular first rim. In some embodiments, the annular tension bolt attachment rim is configured on the first annular rim so that the drumhead snaps into the drum hoop.

In some embodiments, the annular tension bolt attachment rim comprises 6 tension bold attachment moieties for receiving tension bolts. In other embodiments, the annular tension bolt attachment rim comprises 8 tension bold attachment moieties for receiving tension bolts. In still other embodiments, the annular tension bolt attachment rim comprises 10 tension bold attachment moieties for receiving tension bolts. In further embodiments, the annular tension bolt attachment rim comprises 12 tension bold attachment moieties for receiving tension bolts. In still further embodiments, the annular tension bolt attachment rim comprises 14 tension bold attachment moieties for receiving tension bolts. In still further embodiments, the annular tension bolt attachment rim comprises 16 tension bold attachment moieties for receiving tension bolts. In some embodiments, the annular tension bolt attachment rim comprises an odd number of tension bold attachment moieties for receiving tension bolts.

DETAILED DESCRIPTION

Figure 1:
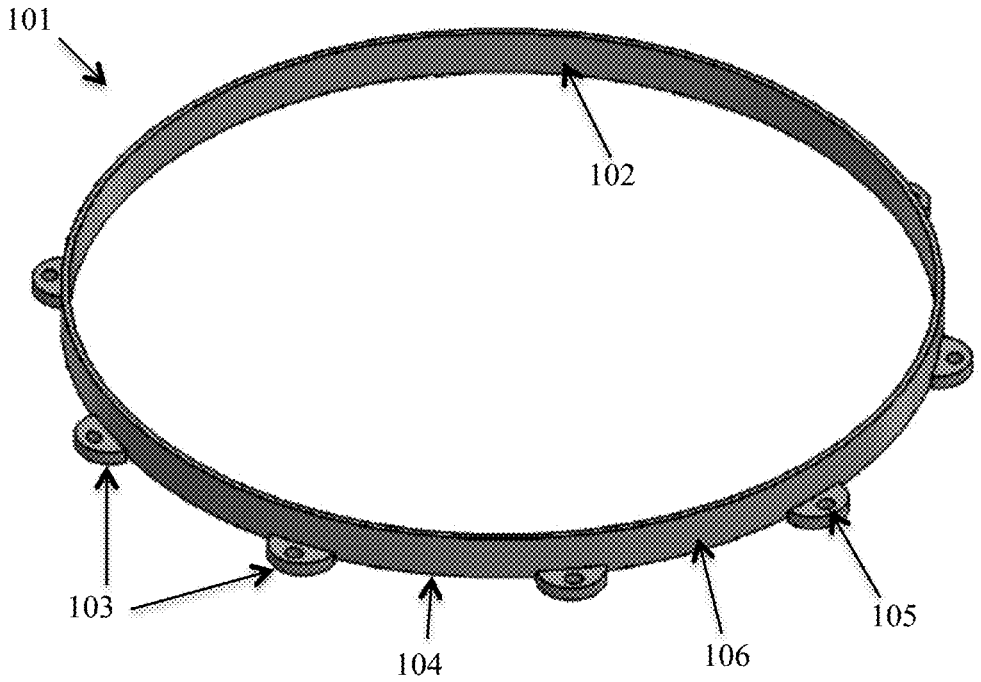
FIG. 1 is a perspective view of an embodiment of the drum hoop of this disclosure.

Currently, drum hoops are typically slightly larger than drumheads so there is excess space between the drumhead and the drum hoop. The excess space allows the drumhead to move around within the drum hoop. Such excess space can be problematic when tuning or playing a drum because the drumhead must be centered in the drum hoop for the drum to emit its clear, proper sound during use. Further, the excess space results in the process of tuning a drum to be tedious because the user must gradually and individually tighten each tension bolt that holds the drum hoop and the drumhead against the drum shell while constantly visually inspecting the drumhead to make sure it is centered in the drum hoop and repeatedly tapping the drumhead to make sure the drum sounds correct and is not muffled. The drum hoop of the instant disclosure eliminates or significantly reduces the excess space between the drumhead and the drum hoop, thereby simplifying the drum tuning process and ensuring that a drum emits its proper sound.

One aspect of this disclosure is directed to a drum hoop comprising an annular rim and a plurality of tension bolt attachment moieties attached to the rim. Each tension bolt attachment moiety comprises an opening for receiving a tension bolt. The tension bolt attachment moieties are configured on the annular rim so that excess space between the drum hoop and a drumhead is eliminated or significantly reduced, thereby allowing the drumhead to fit snugly into the drum hoop. The tension bolt attachment moieties are configured on the annular rim of the drum hoop so that a portion of each tension bolt attachment moiety extends beyond the face of the annular rim, thereby creating a flange. Further, the tension bolt attachment moieties are configured so that the inside surface of each tension bolt attachment moiety contacts or is flush with the outside surface of the annular rim. When a drumhead is placed into the drum hoop, it sits against the face or edge of the annular rim and against the inside surfaces of the tension bolt attachment moieties. Because the drum hoop is the approximately the same diameter as the drumhead, and because the inside surfaces of the tension bolt moieties are flush with, or in contact with, the outside surface of the annular rim, and also extend beyond the face of the annular rim, the drumhead sits snugly centered in the drum hoop. Thus, the drum hoop of the instant disclosure centers the drumhead automatically, thereby simplifying the drum-tuning process and ensuring that the drumhead is in its proper position centered over a drum shell.

The tension bolt attachment moieties can be different shapes. In some embodiments, the tension bolt attachment moieties are shaped like half-moons. In other embodiments, the tension bolt attachment moieties are rectangular. In still other embodiments, the tension bolt attachment moieties are triangular. In some embodiments, the tension bolt attachment moieties are tubular.

The drum hoop can have any number of tension bolt attachment moieties ranging from 6 to 16. In some embodiments, the drum hoop has 6 tension bolt attachment moieties. In other embodiments, the drum hoop has 8 tension bolt attachment moieties. In further embodiments, the drum hoop has 10 tension bolt attachment moieties. In still further embodiments, the drum hoop has 12 tension bolt attachment moieties. In yet other embodiments, the drum hoop has 14 tension bolt attachment moieties. In still other embodiments, the drum hoop has 16 tension bolt attachment moieties. In still other embodiments, the drum hoop has an odd number of tension bolt attachment moieties.

The drum hoop can have a variety of diameters. The diameter of the drum hoop can range from about 6 inches to about 26 inches. In some embodiments, the drum hoop has a diameter ranging from about 10 to about 20 inches. In some embodiments, the drum hoop has a diameter of about 14 inches. In other embodiments, the drum hoop has a diameter of about 13 inches. In some embodiments, the drum hoop has a diameter of about 12 inches. In other embodiments, the drum hoop has a diameter of about 10 inches. In further embodiments, the drum hoop has a diameter of about 18 inches. In other embodiments, the drum hoop has a diameter of about 16 inches. In some embodiments, the drum hoop has a diameter of about 8 inches. In other embodiments, the drum hoop has a diameter of about 6 inches. In further embodiments, the drum hoop has a diameter of 20 inches. In other embodiments, the drum hoop had a diameter of 22 inches. In some embodiments, the drum hoop has a diameter of 24 inches. In the context of inches, the term "about" means plus or minus ½ inch.

The annular rim of the drum hoop can have a range of thickness from about 2 mm to about 20 mm. In some embodiments, the drum hoop can have a range of thickness from about 10 mm to about 15 mm. The annular rim of the drum hoop can have a range of height from about 8 mm to about 25 mm. In some embodiments, the drum hoop can have a range of height from about 15 mm to about 20 mm. In the context of mm (millimeters), the term "about" means plus or minus ½ mm.

In some embodiments, the tension bolt attachment moieties are permanently attached to the drum hoop. In some embodiments, the tension bolt attachment moieties are attached to the annular rim of the drum hoop by welding. In some embodiments, the drum hoop is manufactured by casting metal. In some embodiments, the drum hoop is manufactured by machining. In some embodiments, the tension bolt attachment moieties and the annular rim are formed as one, solitary monolithic piece. In some embodiments the tension bolt attachment moieties are not permanently attached to the annular rim and comprise claws or hooks for holding the drumhead centered in the drum hoop. In some embodiments, the tension bolt attachment moieties are configured on the annular rim so that the drumhead snaps into the drum hoop.

The drum hoop can be made of metal, metal alloy, wood, or can be die cast. The drum hoop can be made of brass, bell brass, bell bronze, bronze, aluminum, steel, alloys of steel (including stainless steel), alloys of iron and zinc, or titanium.

Referring to FIG. 1, drum hoop 101 comprises annular rim 102 and tension bolt attachment moieties 103. Tension bolt attachment moieties 103 are attached to outside face 106 of annular rim 102 and are configured on annular rim 102 so that a portion of each tension bolt attachment moiety extends beyond face 104 of annular rim 102. This configuration of tension bolt attachment moieties 103 creates a flange with face 104 of annular rim 102. The tension bolt attachment moieties 103 each comprise openings 105 for receiving tension bolts.

Figure 2:
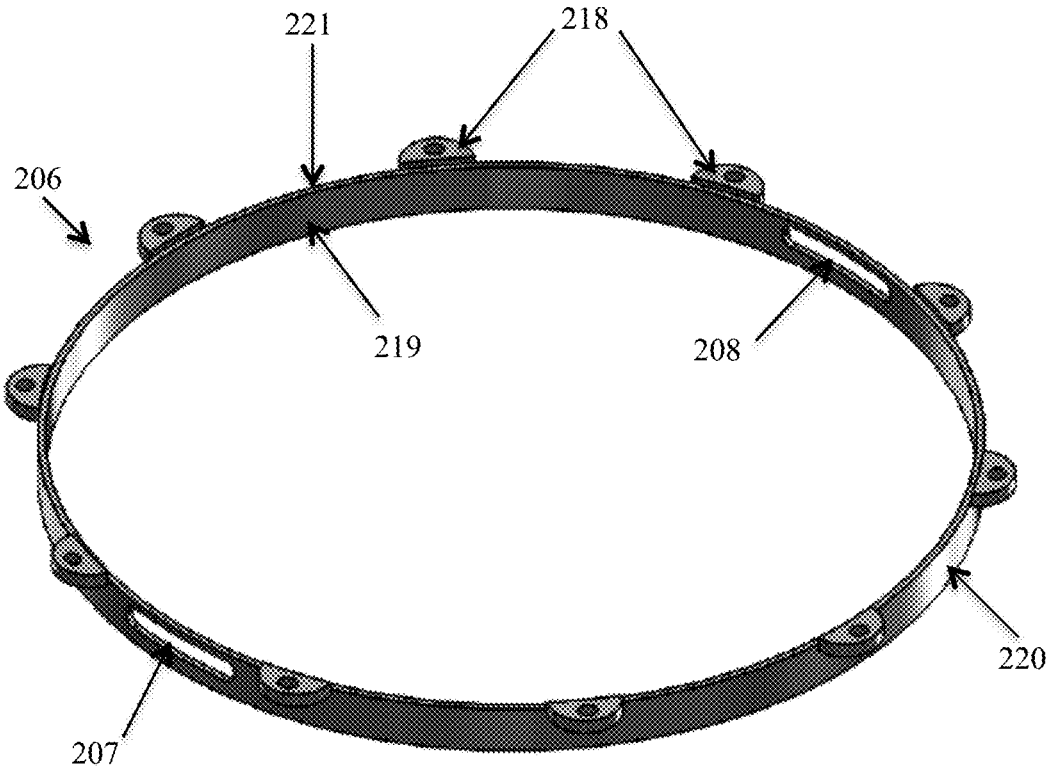
FIG. 2 is a perspective view of an embodiment of the drum hoop of this disclosure that also includes openings for a snare.

A drum hoop of this disclosure can be used as the top or bottom hoop on a drum. Further, a drum hoop of this disclosure can comprise openings to receive a snare. Referring to FIG. 2, drum hoop 206 comprises openings 207 and 208 to receive a snare. Moreover, drum hoop 206 comprises tension bolt attachment moieties 218 configured so that inside surfaces of the tension bolt attachment moieties 218 contact the outside surface 220 of annular rim 219 with portions of tension bolt attachment moieties 218 extending beyond face 221 of annular rim 219.

Figure 3:
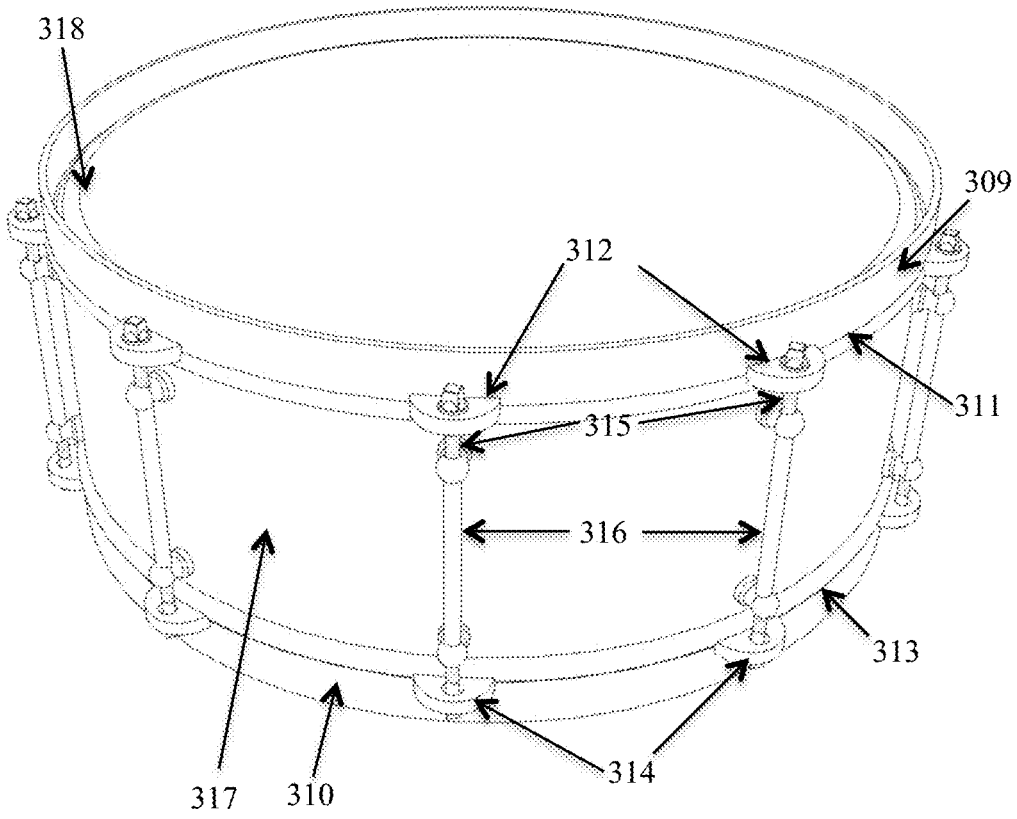
FIG. 3 depicts an assembled drum comprising drum hoops of this disclosure.

FIG. 3 depicts an assembled drum comprising two drum hoops of the instant disclosure. Top drum hoop 309 comprises annular rim 311 and tension bolt attachment moieties 312. Tension bolt attachment moieties 312 are configured on drum hoop 309 so that the inside surfaces of tension bolt attachment moieties 312 contact outside surface of annular rim 311 and extend beyond the bottom face (not shown in FIG) of annular rim 311. Bottom drum hoop 310 comprises annular rim 313 and tension bolt attachment moieties 314. Tension bolt attachment moieties 314 are configured on drum hoop 310 so that the inside surfaces of tension bolt attachment moieties 314 contact outside surface of annular rim 313 and extend beyond the top face of annular rim 313. Tension bolt attachment moieties 312 and 314 receive tension bolts 315 which connect to lugs 316 attached to drum shell 317, thereby holding drumhead 318 against drum shell 317.

Another aspect of this disclosure is directed to a drum hoop comprising a first annular rim comprising an outside surface, an outside diameter, and a face and an annular tension bolt attachment rim comprising an inside surface, an inside diameter equal to the outside diameter of the first annular rim, and a plurality of tension bolt attachment moieties, wherein each tension bolt attachment moiety comprises an opening for receiving a tension bolt. The annular tension bolt attachment rim is attached to the first annular rim so that the inside surface of the annular tension bolt attachment rim is flush with the outside surface of the first annular rim and so that a portion of the annular tension bolt attachment rim extends beyond the face of the first annular rim. Such a configuration eliminates or significantly reduces excess space between a drumhead and the drum hoop, thereby allowing a drumhead to fit snugly into the drum hoop.

In some embodiments, the annular tension bolt attachment rim is permanently attached to the annular first rim. In some embodiments, the annular tension bolt attachment rim is configured on the first annular rim so that a drumhead snaps into the drum hoop. In some embodiments, the annular tension bolt attachment rim further comprises markings for additional openings for receiving tension bolts.

In some embodiments, the annular tension bolt attachment rim comprises 6 openings for receiving tension bolts. In other embodiments, the annular tension bolt attachment rim comprises 8 openings for receiving tension bolts. In still other embodiments, the annular tension bolt attachment rim comprises 10 openings for receiving tension bolts. In further embodiments, the annular tension bolt attachment rim comprises 12 openings for receiving tension bolts. In still further embodiments, the annular tension bolt attachment rim comprises 14 openings for receiving tension bolts. In still further embodiments, the annular tension bolt attachment rim comprises 16 openings for receiving tension bolts. In some embodiments, the annular tension bolt attachment rim comprises an odd number of openings for receiving tension bolts.

EQUIVALENTS

Those skilled in the art will recognize, or be able to ascertain, using no more than routine experimentation, numerous equivalents to the specific embodiments described specifically in this disclosure. Such equivalents are intended to be encompassed in the scope of the following claims.

The invention claimed is:

1. A drum hoop for automatically centering a drumhead in the drum hoop comprising:

an annular rim comprising a face and an outside surface, wherein the annular rim is not flanged; and a plurality of tension bolt attachment moieties, wherein each tension bolt attachment moiety comprises an inside surface and an opening for receiving a tension bolt, wherein each tension bolt attachment moiety is attached to the outside surface of the annular rim so that the inside surface of the tension bolt attachment moiety contacts the outside surface of the annular rim, wherein a portion of each tension bolt attachment moiety extends beyond the face of the annular rim, and wherein the drum hoop is sized and configured so that the face of the annular rim and a plurality of the inside surfaces of the plurality of tension bolt attachment moieties hold a drumhead in place in the drum hoop in the absence of a drum shell wherein the drum hoop is sized and configured to hold a drumhead in place against the face of the annular rim and against a plurality of the inside surfaces of the plurality of tension bolt attachment moieties.

2. The drum hoop of claim 1, having between 6 and 16 tension bolt attachment moieties.

3. The drum hoop of claim 1, wherein the drum hoop comprises brass, bell brass, bell bronze, bronze, aluminum, steel, alloys of steel, stainless steel, alloys of iron, alloys of zinc, or titanium.

4. The drum hoop of claim 3, wherein the drum hoop comprises stainless steel.

5. The drum hoop of claim 1, further comprising openings for a snare.

6. The drum hoop of claim 1, wherein the tension bolt attachment moieties are shaped like half moons.

7. The drum hoop of claim 1, wherein the annular rim has a diameter between about 6 to about 26 inches.

8. The drum hoop of claim 7, wherein the annular rim has a diameter between about 10 and about 20 inches.

9. The drum hoop of claim 1, wherein the annular rim has a thickness of between about 2 to about 20 mm.

10. The drum hoop of claim 1, wherein the annular rim has a height ranging from about 8 to about 25 mm.

11. A drum hoop for automatically centering a drumhead in the drum hoop comprising:

an annular rim comprising a face and an outside surface, wherein the annular rim is not flanged; and a plurality of tension bolt attachment moieties, wherein each tension bolt attachment moiety comprises an inside surface and an opening for receiving a tension bolt, wherein each tension bolt attachment moiety is attached to the outside surface of the annular rim so that the inside surface of the tension bolt attachment moiety contacts the outside surface of the annular rim, wherein a portion of each tension bolt attachment moiety extends beyond the face of the annular rim, and wherein the drum hoop is sized and configured to hold a drumhead in place against the face of the annular rim and against a plurality of the inside surfaces of the plurality of tension bolt attachment moieties in the absence of a drum shell.

12. The drum hoop of claim 11, having between 6 and 16 tension bolt attachment moieties.

13. The drum hoop of claim 11, wherein the drum hoop comprises brass, bell brass, bell bronze, bronze, aluminum, steel, alloys of steel, stainless steel, alloys of iron, alloys of zinc, or titanium.

14. The drum hoop of claim 13, wherein the drum hoop comprises stainless steel.

15. The drum hoop of claim 11, further comprising openings for a snare.

16. The drum hoop of claim 11, wherein the tension bolt attachment moieties are shaped like half moons.

17. The drum hoop of claim 11, wherein the annular rim has a diameter between about 6 to about 26 inches.

18. The drum hoop of claim 17, wherein the annular rim has a diameter between about 10 and about 20 inches.

19. The drum hoop of claim 11, wherein the annular rim has a thickness of between about 2 to about 20 mm.

20. The drum hoop of claim 11, wherein the annular rim has a height ranging from about 8 to about 25 mm.

* * * * *